US009932761B2

(12) United States Patent
Hamada

(10) Patent No.: US 9,932,761 B2
(45) Date of Patent: Apr. 3, 2018

(54) VEHICULAR DOOR DEVICE

(71) Applicant: HONDA MOTOR CO., LTD., Tokyo (JP)

(72) Inventor: Atsushi Hamada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 131 days.

(21) Appl. No.: 14/614,007

(22) Filed: Feb. 4, 2015

(65) Prior Publication Data

US 2015/0218857 A1 Aug. 6, 2015

(30) Foreign Application Priority Data

Feb. 4, 2014 (JP) ..... 2014-019646

(51) Int. Cl.
*E05C 3/02* (2006.01)
*E05B 85/20* (2014.01)
(Continued)

(52) U.S. Cl.
CPC ..... *E05B 85/20* (2013.01); *E05B 47/0676* (2013.01); *E05B 77/22* (2013.01);
(Continued)

(58) Field of Classification Search
CPC ..... E05B 47/0676; E05B 77/22; E05B 79/20; E05B 81/14; E05B 81/16; E05B 81/78;
(Continued)

(56) References Cited

U.S. PATENT DOCUMENTS 4,738,334 A * 4/1988 Weishaupt ..... G07C 9/00309 180/287
5,497,641 A * 3/1996 Linde ..... E05B 81/14 180/289

(Continued)

FOREIGN PATENT DOCUMENTS

JP 3921156 B2 5/2007
JP 2008-2085 A 1/2008

OTHER PUBLICATIONS

Japanese Office Action dated Nov. 24, 2015 (mailing date), issued in counterpart Japanese Patent Application No. 2014-019646 with English translation.

*Primary Examiner* — Kristina Fulton
*Assistant Examiner* — Faria Ahmad
(74) *Attorney, Agent, or Firm* — Westerman, Hattori, Daniels & Adrian, LLP

(57) ABSTRACT

A vehicular door device in which an inner handle is connected to a latch mechanism with a wire so as to be capable of being linked, and in which a latch release restriction device that disables and restricts a link between the inner handle and the latch is provided in an operation transmission path ranging from the inner handle to the latch with the wire in between. A release motor that actuates the latch in an engagement releasing direction is provided, the release motor being linked to the latch without having the wire between itself and the latch. When a switch operation of the door opening switch is performed, restriction to the link performed by the latch release restriction device is cancelled and the release motor is actuated in the engagement releasing direction without waiting for the cancellation of the restriction to be completed.

16 Claims, 6 Drawing Sheets

(51) Int. Cl.

| | |
|---|---|
| ***E05B 47/06*** | (2006.01) |
| ***E05B 79/20*** | (2014.01) |
| ***E05B 81/14*** | (2014.01) |
| ***E05B 81/16*** | (2014.01) |
| ***E05B 81/78*** | (2014.01) |
| ***E05B 85/12*** | (2014.01) |
| ***E05B 77/22*** | (2014.01) |
| *E05C 3/00* | (2006.01) |
| *E05C 3/04* | (2006.01) |
| *E05C 3/06* | (2006.01) |
| *E05C 3/16* | (2006.01) |

(52) U.S. Cl.
CPC ..... *E05B 79/20* (2013.01); *E05B 81/14* (2013.01); *E05B 81/16* (2013.01); *E05B 81/78* (2013.01); *E05B 85/12* (2013.01); *Y10T 292/1043* (2015.04)

(58) Field of Classification Search
CPC ... E05B 85/12; Y10T 292/1043; Y10S 292/23
USPC ..... 292/194, 195, 200, 201, 210, 216, 292/DIG. 23, 336.3, DIG. 30
See application file for complete search history.

(56) References Cited

U.S. PATENT DOCUMENTS 5,680,783 A * 10/1997 Kuroda ..... E05B 17/22 292/201
5,682,135 A * 10/1997 Labonde ..... G07C 9/00309 180/287
5,901,991 A * 5/1999 Hugel ..... E05B 81/14 292/201
6,367,296 B1 * 4/2002 Dupont ..... E05B 81/16 292/201
6,575,003 B1 * 6/2003 Dupont ..... E05B 81/14 292/201
6,588,813 B1 * 7/2003 Marcarini ..... E05B 85/16 292/336.3
6,597,284 B2 * 7/2003 Juzswik ..... B60C 23/0408 340/10.1
6,786,530 B2 * 9/2004 Fisher ..... E05B 81/14 296/146.1
7,091,836 B2 * 8/2006 Kachouh ..... E05B 81/14 307/10.1
2003/0155779 A1 * 8/2003 Belmond ..... E05B 81/06 292/216
2004/0232707 A1 * 11/2004 Kachouh ..... E05B 81/14 292/216
2005/0057047 A1 * 3/2005 Kachouh ..... E05B 81/14 292/201
2005/0093305 A1 * 5/2005 Jackson ..... E05B 77/26 292/216
2007/0290796 A1 12/2007 Teshima et al.
2008/0054649 A1 * 3/2008 Ueda ..... E05B 81/78 292/216
2008/0224482 A1 * 9/2008 Cumbo ..... E05B 77/02 292/216
2009/0267359 A1 * 10/2009 Takayanagi ..... E05B 81/14 292/201
2010/0026014 A1 * 2/2010 Machida ..... E05B 65/08 292/216
2010/0032965 A1 * 2/2010 Kargilis ..... E05B 81/14 292/216
2011/0101709 A1 * 5/2011 Katsumata ..... E05B 81/14 292/201
2013/0104459 A1 * 5/2013 Patel ..... E05B 47/0657 49/70
2013/0338883 A1 * 12/2013 Savoure ..... H04L 9/3234 701/49
2014/0049056 A1 * 2/2014 Scholz ..... E05B 81/14 292/200
2014/0137474 A1 * 5/2014 Suzuki ..... E05F 15/611 49/31
2015/0084352 A1 * 3/2015 Barmscheidt ..... E05B 81/15 292/201
2015/0233145 A1 * 8/2015 Kuriyama ..... E05B 41/00 292/201
2015/0240534 A1 * 8/2015 Kuriyama ..... E05B 79/20 292/201
2015/0267441 A1 * 9/2015 Fuchs ..... E05B 81/68 292/200
2015/0284977 A1 * 10/2015 Barmscheidt ..... E05B 81/14 292/200
2016/0123045 A1 * 5/2016 Bingle ..... E05B 81/76 292/336.3

* cited by examiner

VEHICULAR DOOR DEVICE

CROSS REFERENCES TO RELATED APPLICATIONS

The present application claims priority under 35 U.S.C. § 119 to Japanese Patent Application No. 2014-019646, filed Feb. 4, 2014, entitled "Vehicular Door Device." The contents of this application are incorporated herein by reference in their entirety.

TECHNICAL FIELD

The disclosure relates to a vehicular door device.

BACKGROUND

In vehicular door devices, a latch of a latch mechanism provided in a door body engages with a striker on a vehicle body side when the door body is in a closed state. The latch is connected to a release handle mechanism (an inner handle and an outer handle) of the door body through an operation transmission member, such as a cable, and releases the engagement with the striker upon operation of the release handle mechanism.

In recent years, among such door devices, a door device has been devised in which a latch release actuator, such as an electric motor, is attached to the latch, and in which the latch release actuator releases the engagement of the latch when an instruction signal is input from an opening switch, such as a touch sensor (see Japanese Patent No. 3921156 and Japanese Unexamined Patent Application Publication No. 2008-2085, for example).

In a door device that is employed in a rear gate such as the door device described in Japanese Patent No. 3921156, a latch engagement releasing operation and locking of the door (locking the release of the latch) can be achieved by control of the latch release actuator alone. However, in a side door of a vehicle, for example, in considering escape from the vehicle interior in case of emergency, the release handle mechanism and the latch needs to be connected to each other with a mechanical operation transmission member, such as a cable, while the latch release actuator is attached to the latch.

Accordingly, in the door device described in Japanese Unexamined Patent Application Publication No. 2008-2085, the release handle mechanism and the latch are connected to each other with a cable serving as the operation transmission member, and a latch release restriction device (a lock device) is provided in an operation transmission path ranging from the release handle mechanism to the latch with the cable in between, in which the latch release restriction device disables and restricts the link between the release handle mechanism and the latch that are linked through the operation transmission path. An actuator portion of the latch release restriction device is connected to an opening switch, such as a touch sensor, and when an instruction signal is input from the opening switch, the actuator portion enables the link between the release handle mechanism and the latch. With the above, the door device gets into an unlocked state that allows a releasing operation of the latch to be performed with the release handle mechanism.

After the door device described in Japanese Unexamined Patent Application Publication No. 2008-2085 gets into the unlocked state in the above described manner, upon subsequently receiving a pop-up operation instruction from the operator, the engagement of the latch is released with the latch release actuator and the door body is popped up. Furthermore, after getting into the unlocked state as described above, when the release handle mechanism is operated, the latch is directly operated through the cable and the engagement of the latch is released.

SUMMARY

However, in the door device described in Japanese Unexamined Patent Application Publication No. 2008-2085, since the releasing operation of the latch release actuator is performed after waiting for the restriction cancelling operation of the latch release restriction device (the lock device) to be completed, a time loss occurs from when the opening switch is operated to when the releasing of the engagement of the latch is completed; accordingly, waiting time until the door body is opened is longer.

Therefore, the present application describes a vehicular door device that is capable of swiftly releasing the engagement of the latch and opening the door body from a state in which the release of the latch engaged with the release handle mechanism is restricted with the latch release restriction device.

In order to overcome the above issue, the vehicular door device according to the disclosure employs the following configuration. In the following explanation of the exemplary aspects, specific elements with their reference numerals are indicated by using brackets. These specific elements are presented as mere examples in order to facilitate understanding, and thus, should not be interpreted as any limitation to the accompanying claims.

In a first aspect of the disclosure, a vehicular door device, a door body (a door body 2 of the exemplary embodiment, for example) of which is attached to a door opening portion of a vehicle in an openable and closable manner, includes a latch mechanism (a latch mechanism 11 of the exemplary embodiment, for example) provided in the door body, the latch mechanism including a latch (a latch lever 21 and a lock lever 22 of the exemplary embodiment, for example) that, when the door body is in a closed state, engages with a striker (a striker 3 of the exemplary embodiment, for example) on a vehicle body side and restricts the door body from being displaced in an opening direction; a release handle mechanism (an inner handle 12 of the exemplary embodiment, for example) that is provided in the door body, the release handle mechanism releasing the engagement between the latch and the striker according to an operation of an operator; an operation transmission member (a wire 13 of the exemplary embodiment, for example) that mechanically transmits an operation of the release handle mechanism to the latch; a latch release restriction device (a latch release restriction device 15 of the exemplary embodiment, for example) that is provided midway of an operation transmission path ranging from the release handle mechanism to the latch with the operation transmission member in between, the latch release restriction device disabling and restricting a link between the release handle mechanism and the latch that are linked through the operation transmission path; a latch release actuator (a release motor 20 of the exemplary embodiment, for example) that is linked to the latch without the operation transmission member in between, the latch release actuator actuating the latch in an engagement releasing direction; and a door opening switch (a touch sensor 17 of the exemplary embodiment, for example) that, when a switch operation is performed by the operator, cancels a restriction of the link between the release handle mechanism and the latch performed by the latch release restriction device, in which when the switch operation is performed on the door opening switch, a cancellation of the restriction of the link performed by the latch release restriction device is performed and the latch release actuator is actuated in the engagement releasing direction without waiting for the cancellation of the restriction to be completed.

With the above configuration, when the latch release restriction device is actuated in a restriction direction, the link between the release handle mechanism and the latch that are linked through the operation transmission path is restricted (disabled) and the door body is locked in a closed state. In the above state, when the operator operates the door opening switch, cancellation of the restriction of the link between the release handle mechanism and the latch performed by the latch release restriction device is performed and the latch release actuator is actuated in a direction that releases the engagement of the latch without waiting for the cancellation of the restriction to be completed. Accordingly, early release of the engagement between the latch and the striker is achieved.

Furthermore, when the restriction (disablement) of the link between the release handle mechanism and the latch is cancelled, the engagement of the latch can be released by operating the release handle mechanism through the operation transmission member. Accordingly, even if the latch release actuator should malfunction, as long as the link between the release handle mechanism and the latch is enabled, the engagement of the latch can be released by operating the release handle mechanism.

In a second aspect of the disclosure, the operation transmission member is a wire (the wire 13 of the exemplary embodiment, for example) that performs a releasing operation of the latch by performing a pulling operation with the release handle mechanism, the latch release restriction device includes an engagement piece (an engagement piece 30 of the exemplary embodiment) that is connected to the wire and is capable of being engaged to and released from the release handle mechanism, and releasing of the engagement piece from the release handle mechanism disables and restricts the link between the release handle mechanism and the latch.

In such a case, when the engagement piece that is connected to the latch through the wire is engaged with the release handle mechanism, the engagement of the latch can be released by performing a pulling operation with the release handle mechanism. In the above state, the wire slackens when the latch is operated in the engagement releasing direction with the latch release actuator; accordingly, abrupt transmission of the operation from the latch to the release handle is disabled or relieved. With the above, the release handle mechanism can be prevented from moving unintentionally in an abrupt manner.

In a third aspect of the disclosure, the release handle mechanism is provided on at least the vehicle interior side of the door body and the door opening switch is provided on at least the vehicle exterior side of the door body.

In such a case, since the release handle mechanism to which the operation transmission member is connected is provided at lease inside the vehicle interior of the door body, even if the latch release actuator should malfunction when the occupant is in the vehicle, the occupant can escape to the outside of the vehicle by operating the release handle mechanism from the vehicle interior. Furthermore, the engagement of the latch can be easily released by performing a switch operation of the door opening switch from the outside of the vehicle where there is no worry of being locked in.

In a fourth aspect of the disclosure, when locking an opening operation of the door body when an occupant is not in the vehicle, the operation of the latch in the engagement releasing direction performed by the latch release actuator is restricted while the restriction of the link between the release handle mechanism and the latch performed by the latch release restriction device is cancelled.

In such a case, since the operation of the latch release actuator is restricted, the latch is locked in the engaged state. At this point, since the latch release restriction device does not operate in the direction that restricts the link, abnormal noise generated by operation of the latch release restriction device does not occur. Accordingly, marketability of the door device increases.

In a fifth aspect of the disclosure, the latch gets into a fully-latched state, the fully-latched state being a state in which the latch is engaged with the striker on the vehicle body side while the door body is in a completely closed state, and into a half-latched state, the half-latched state being a state in which the latch is engaged with the striker on the vehicle body side while the door body is not in a completely closed state, and while the latch is in the fully-latched state, when the opening switch is operated with no performance of an opening operation on the door body, the latch is kept in the half-latched state until the opening operation such as pulling the door is performed on the door body.

In such a case, while the latch is in the fully-latched state, when the opening switch is operated with no performance of an opening operation on the door body, the half-latched state is maintained unless an opening operation is performed on the door body; accordingly, even if the operator should touch the touch sensor by mistake, the door body can be prevented from opening abruptly.

In a sixth aspect of the disclosure, the door opening switch is provided in a holding portion (a holding portion **16*a*** of the exemplary embodiment, for example) of the door body, the holding portion being held by the operator to open and close the door body.

In such a case, by being held by the operator, the holding portion having the door opening switch gets the latch into an engagement released state. The operator can perform an opening operation on the door body in a continuous manner after the release of the engagement of the latch by holding the holding portion and pulling the door body.

In a seventh aspect of the disclosure, the door opening switch maintains the latch in an engagement released state while the holding portion is held by the operator.

In such a case, since the latch is maintained in the engagement released state when the operator holds the holding portion and pulls the door body in a sequential manner, the door body can be opened in a smooth manner without the latch undergoing a transition to the half-latched state.

According to the disclosure, when the door opening switch is operated by the operator while the release of the latch by the release handle mechanism is restricted with the latch release restriction device, the restriction to the link by the latch release restriction device is cancelled and the latch release actuator is actuated in the direction that releases the engagement of the latch without waiting for the cancellation of the restriction of the link to be completed; accordingly, the engagement of the latch can be swiftly released to open the door.

BRIEF DESCRIPTION OF THE DRAWINGS

The advantages of the disclosure will become apparent in the following description taken in conjunction with the following drawings.

DESCRIPTION OF THE PREFERRED EMBODIMENTS

Hereinafter, an exemplary embodiment of the disclosure will be described with reference to the drawings.

Figure 1:
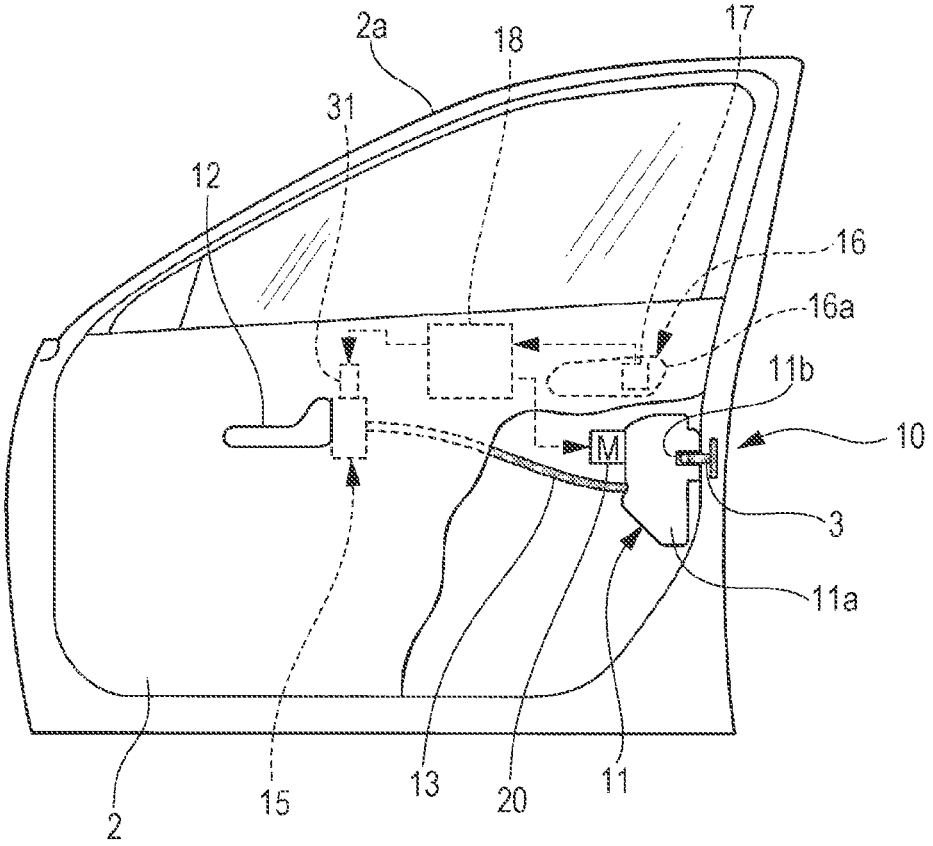
FIG. 1 is a front view of a partially cutaway side door according to an exemplary embodiment of the disclosure.

FIG. 1 is a diagram of a partially cutaway side door on a front side of a vehicle body seen from a vehicle interior. A door device 10 according to the exemplary embodiment is employed in the above side door. The door device 10 is included in a door body 2 and a front portion of a door body 2 including a door sash portion 2*a* is attached to a door opening portion of the vehicle body (not shown) in an openable and a closable manner. A weather strip (not shown) that is formed of a rubber elastic body is attached to a peripheral edge portion of the door body 2 and to a peripheral edge of the door opening portion on the vehicle body side to seal the peripheral edge portion of the closed door body 2.

A latch mechanism 11 that engages with a striker 3 on the vehicle body side to restrict the door body 2 from being displaced in the opening direction when the door body 2 is in a closed state is provided in a rear edge portion of the door body 2. The striker 3 is provided at a rear edge of the door opening portion of the vehicle body so as to protrude along the side of the vehicle compartment. A receiving opening 11*b* that permits the striker 3 to relatively enter therein from the vehicle interior side during a closing operation of the door body 2 is provided in a latch housing 11*a* that accommodates the latch mechanism 11. The latch mechanism 11 is provided with an electric release motor 20 (a latch release actuator) for releasing the engagement with the striker 3. Note that the details of the latch mechanism 11 will be described later.

An inner handle 12 (a release handle mechanism) that releases the engagement of the latch mechanism 11 from the vehicle interior side is pivotally attached to the door body 2 on the vehicle interior side. The inner handle 12 is mechanically connected to the latch mechanism 11 through a wire 13 serving as an operation transmission member. One end of the wire 13 is connected to the inner handle 12 through a latch release restriction device 15 described later in detail and the other end of the wire 13 is directly connected to a lock lever 22 (see FIGS. 2 and 3) of the latch mechanism 11.

An outer handle 16 for performing an opening operation of the door body 2 from the outside of the vehicle is attached to the door body 2 on the vehicle exterior side. A touch sensor 17 serving as an opening switch is attached to a holding portion 16*a* of the outer handle 16. The touch sensor 17 is connected to a signal input unit of a controller 18, the controller 18 controlling the operation of the release motor 20 and the latch release restriction device 15.

Figure 2:
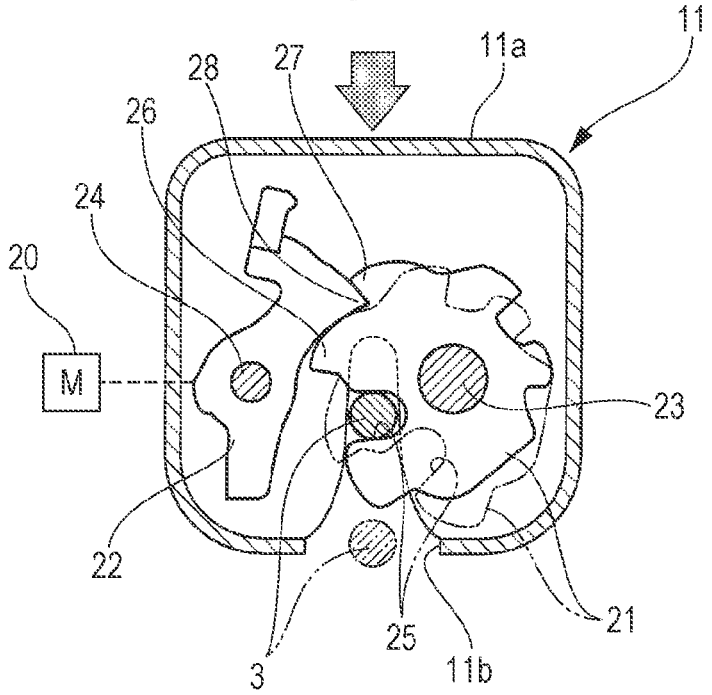
FIG. 2 is a schematic cross-sectional view of a latch of a door device according to the exemplary embodiment of the disclosure.
Figure 3:
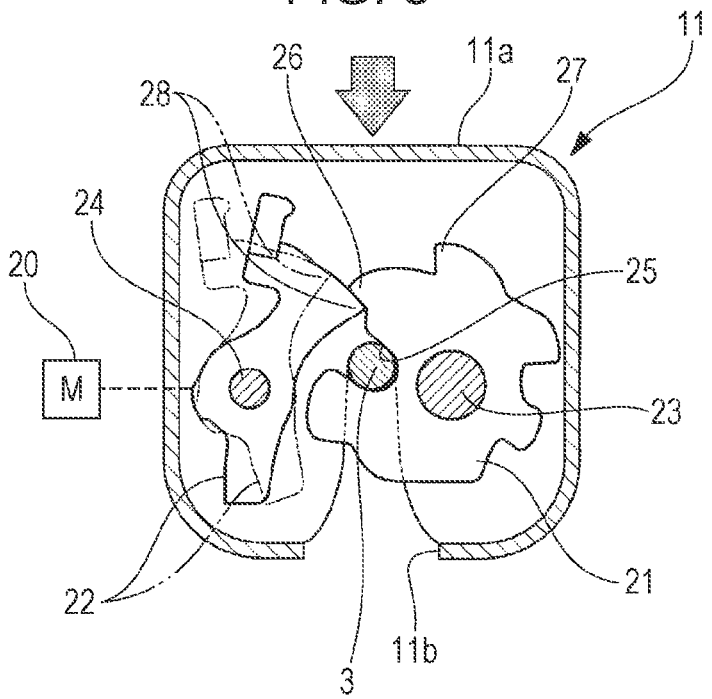
FIG. 3 is a schematic cross-sectional view of the latch of the door device according to the exemplary embodiment of the disclosure.

FIGS. 2 and 3 are cross-sectional views each illustrating a schematic configuration of the latch mechanism 11 of the exemplary embodiment. The latch mechanism 11 gets into a fully-latched state in which the latch mechanism 11 engages with the striker 3 while the door body 2 is completely closed and into a half-latched state in which the latch mechanism 11 engages with the striker 3 while the door body 2 is not completely closed. FIG. 2 illustrates the half-latched state of the latch mechanism 11 and FIG. 3 illustrates the fully-latched state of the latch mechanism 11.

A latch lever 21 that engages with the striker 3 on the vehicle body side, and the lock lever 22 that restricts pivoting of the latch lever 21 are accommodated inside the latch housing 11*a* of the latch mechanism 11. The latch lever 21 and the lock lever 22 are pivotally supported by the support shafts 23 and 24, respectively, inside the latch housing 11*a*. The support shafts 23 and 24 are disposed inside the latch housing 11*a* on both sides of the entering direction of the striker 3 that has passed through the receiving opening 11*b* and are disposed parallel to each other. In the present exemplary embodiment, the latch lever 21 and the lock lever 22 constitute a latch of the latch mechanism 11.

The latch lever 21 includes, in its outer edge portion around the support shaft 23, a holding groove 25 that can hold the striker 3 while the striker 3 is inserted therein, a full-latch locking claw 26 that engages with the lock lever 22 at the fully-latched position (a position in which the latch is in a fully-latched state), a half-latch locking claw 27 that engages with the lock lever 22 at the half-latched position (a position in which the latch is in a half-latched state). The lock lever 22 includes, in its outer edge portion around the support shaft 24, a lock claw 28 that engages with the full-latch locking claw 26 and the half-latch locking claw 27 of the latch lever 21.

The latch lever 21 is biased in the counterclockwise direction in FIGS. 2 and 3 with a biasing spring (not shown). As illustrated by a virtual line in FIG. 2, in the initial state, an opening of the holding groove 25 faces the receiving opening 11*b* side. Furthermore, the lock lever 22 is biased in the clockwise direction in FIGS. 2 and 3 with a biasing spring (not shown), and when the latch lever 21 is pivoted in the clockwise direction upon entry of the striker 3 into the holding groove 25, the lock claw 28 is urged against the latch lever 21.

When the striker 3 enters the latch housing 11*a* while the striker 3 is held by the holding groove 25 and when the latch lever 21 is pivoted to the half-latched position as illustrated in FIG. 2, the lock claw 28 of the lock lever 22 engages with the half-latch locking claw 27 of the latch lever 21. As a result, the latch mechanism 11 is kept at a half-latched state. Furthermore, when the striker 3 further enters into the latch housing 11*a* from the above state, the latch lever 21 pivotally displaces the lock lever 22 in the counterclockwise direction and the latch lever 21 is pivoted to the fully-latched position as illustrated in FIG. 3. At this point, the lock claw 28 of the lock lever 22 engages with the full-latch locking claw 26 of the latch lever 21. As a result, the latch mechanism 11 is kept at a fully-latched state.

Furthermore, when releasing the engagement between the latch mechanism 11 and the striker 3 in the above-described state in which the latch mechanism 11 is kept at a half-latched state or a fully-latched state, the lock lever 22 is pivoted in the counterclockwise direction in FIGS. 2 and 3 by an external operation force.

Note that the release motor 20 described above is connected to the lock lever 22 of the latch mechanism 11 so as to allow pivotal operation to be performed, and the wire 13 described above is connected to the lock lever 22 as well so that the operation of the inner handle 12 is linked with the lock lever 22. The external operation force when releasing the engagement of the latch mechanism 11 is basically applied from either one of the release motor 20 and the wire 13.

Figure 4:
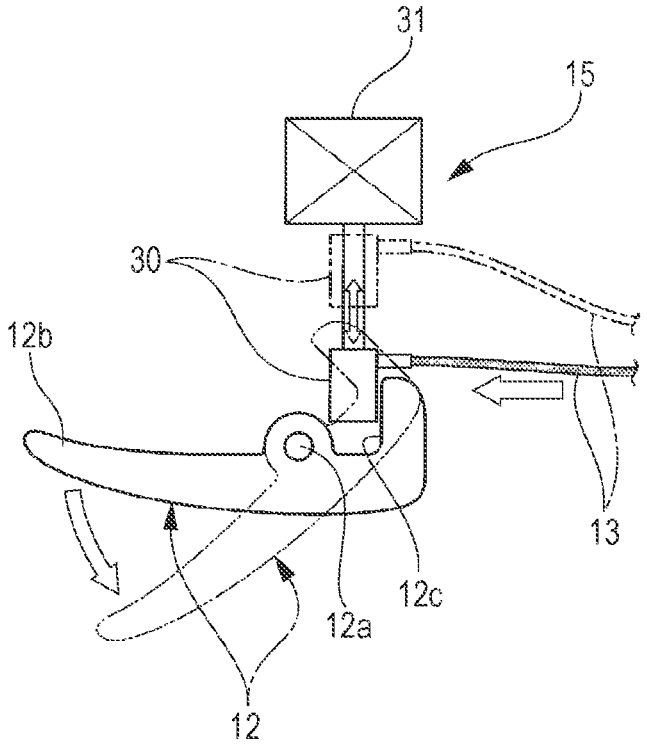
FIG. 4 is a schematic cross-sectional view of a latch release restriction device of the door device according to the exemplary embodiment of the disclosure.

FIG. 4 is a diagram schematically illustrating a schematic configuration of the latch release restriction device 15.

The inner handle 12 is pivotally supported by the door body 2 about a pivot shaft 12*a*. A lock groove 12*c* is formed in the inner handle 12 so as to have the pivot shaft 12*a* between itself and an operating portion 12*b* held by the operator and is formed on an end portion of the inner handle 12 on the opposite side of the operating portion 12*b*. The latch release restriction device 15 includes an engagement piece 30 that is connected to one end of the wire 13, the engagement piece being capable of being engaged with and released from the lock groove 12*c* of the inner handle 12. The engagement piece 30 is disposed at a position that opposes the lock groove 12*c* of the inner handle 12. The engagement piece 30 is capable of advancing and retreating. Engagement with and release from the lock groove 12*c* are performed as required with an electromagnetic actuator 31. Application of current to the electromagnetic actuator 31 is controlled by the controller 18. Note that the controller 18 that controls the application of current to the electromagnetic actuator 31 may be provided inside the door body 2 or may be provided on the vehicle body side.

When the inner handle 12 is pivoted when the engagement piece 30 is engaged with the lock groove 12*c* of the inner handle 12, the wire 13 is pulled by the inner handle 12. Accordingly, in the above state, the inner handle 12 can release the engagement of the latch mechanism 11. On the other hand, when the engagement piece 30 is released from the lock groove 12*c* of the inner handle 12, even if the inner handle 12 is pivoted, the wire 13 will not be pulled by the inner handle 12. Accordingly, in the above state, releasing of the latch mechanism 11 with the inner handle 12 is restricted (disabled) with the latch release restriction device 15 and the locked state of the door body 2 is maintained.

Incidentally, the door device 10 of the exemplary embodiment is capable of performing bidirectional communication with a portable electronic key (not shown). When a hand of the operator touches the touch sensor 17 or when the operator enters an area around the vehicle by a predetermined distance while the door body 2 that is in a closed state is locked, the electronic key sends an ID code to the vehicle body and the ID code of the electronic key is compared with the ID code that has been preregistered to the vehicle. At this time, when the ID codes match each other, lock release control by the controller 18 is permitted, and when the ID codes do not match each other, lock release control by the controller 18 is not permitted.

When a signal is input from the touch sensor 17, the controller 18 actuates the electromagnetic actuator 31 of the latch release restriction device 15 to allow the inner handle 12 and the latch mechanism 11 to be linked to each other with the wire 13 and, at the same time, actuates the release motor 20 to pivot the lock lever 22 of the latch mechanism 11 in the lock release direction. Note that in the present exemplary embodiment, while the signal is sent from the touch sensor 17 (while the operator is touching the touch sensor 17), the actuation of the release motor 20 is continued so that the latch mechanism 11 maintains the engagement released state.

Furthermore, in the present exemplary embodiment, the release motor 20 is actuated at the same time as the actuation of the electromagnetic actuator 31; however, the start of the actuation of the release motor 20 may be earlier than the start of the actuation of the electromagnetic actuator 31. Conversely, the start of the operation of the electromagnetic actuator 31 may be earlier than the start of the operation of the release motor 20.

Furthermore, in the present exemplary embodiment, since the elastic weather strip is set between the peripheral edge of the door body 2 and the peripheral edge of the door opening portion on the vehicle body side, when the door body 2 is not operated in the opening direction and when only an instruction signal is sent to the controller 18 from the touch sensor 17 while the door body 2 is completely closed, the door body 2, receiving the force created by the elasticity of the weather strip, is slightly pushed open upon release of the engagement of the latch mechanism 11 described above. Accordingly, in the above state, when the operation of the release motor 20 stops upon, for example, separation of the hand of the operator from the touch sensor 17, the latch mechanism 11 is kept in a half-latched state as illustrated in FIG. 2.

Note that in the present exemplary embodiment, while the signal is sent from the touch sensor 17, the drive of the release motor 20 is controlled so that the engagement released state of the latch mechanism 11 is maintained; accordingly, when the operator touches the touch sensor 17, holds the outer handle 16, and pulls the door body 2 to the outside, the door body 2 is opened without the latch mechanism 11 undergoing a transition to the half-latched state.

Furthermore, in the present exemplary embodiment, the occupant with the electronic key can lock the door body 2 to the closed state from the outside of the vehicle. In such a case, the rotation of the electronic release motor 20 is stopped while the restriction of the link between the inner handle 12 and the latch mechanism 11 performed by the latch release restriction device 15 is cancelled (while the inner handle 12 and the latch mechanism 11 are kept in the linked state). Accordingly, even while the inner handle 12 and the latch mechanism 11 is allowed to be linked to each other with the wire 13, the operation of the latch mechanism 11 is locked by the release motor 20, and, as a result, the door body 2 is maintained in the closed state.

Figure 5:
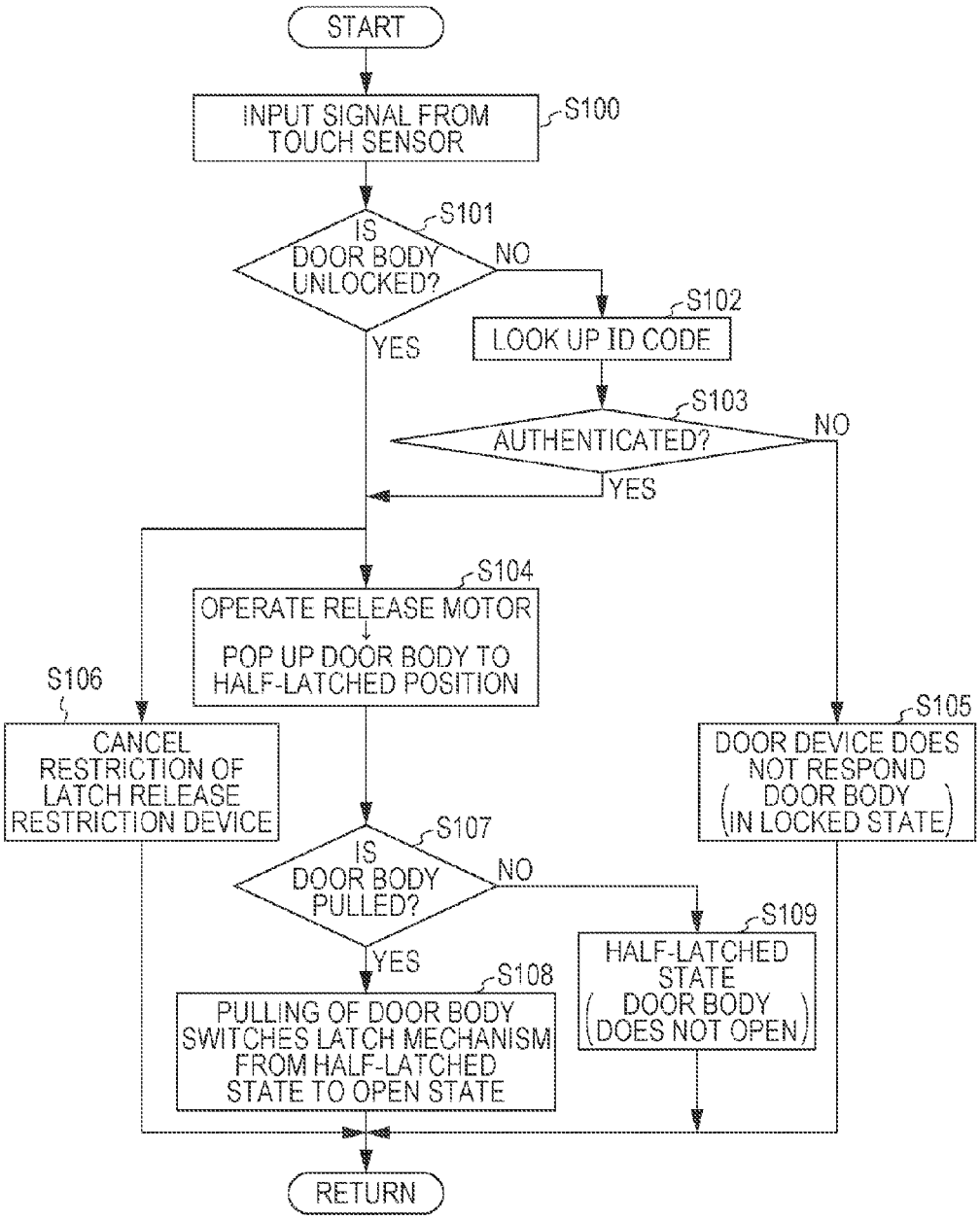
FIG. 5 is a flow chart illustrating an operation of the door device according to the exemplary embodiment of the disclosure.

FIG. 5 is a flow chart illustrating an operation of the door device 10 when the door device 10 is operated from the outside.

Hereinafter, an operation of the door device 10 will be described with reference to the flow chart.

In the flow chart of FIG. 5, after the touch sensor 17 is touched by the operator in step S100, when the door body 2 is in a locked state, the process proceeds from step S101 to step S102, and when the door body 2 is in an unlocked state, the process proceeds from step S101 to step S104 and step S106.

In step S102, the ID code is looked up so as to check whether the operation is carried out by an operator who possesses a legitimate electronic key, and when a proper ID code is sent from the electronic key, the process proceeds from step S103 to step S104 and step S106, and when the proper ID code is not sent from the electronic key, the process proceeds from step S103 to step S105. In step S105, the door device 10 does not respond and the door body 2 is kept in a locked state.

In step S104, the controller 18 controls the release motor 20 so that the release motor 20 is actuated in a direction that releases the latch mechanism 11. At this time, in the latch mechanism 11, the lock lever 22 pivots in the releasing direction and the latch lever 21 tries to return towards the initial position.

Meanwhile, in step S106, the controller 18 controls the electromagnetic actuator 31 so that the electromagnetic actuator 31 is actuated in the direction that engages the engagement piece 30 of the latch release restriction device 15 with the lock groove 12*c* of the inner handle 12. Accordingly, the link between the inner handle 12 and the latch mechanism 11 is enabled.

Note that in the present exemplary embodiment, it is desirable that the actuation of the release motor 20 in step S104 and the actuation of the electromagnetic actuator 31 in step S106 start at the same time. However, it is only sufficient that the actuation of the release motor 20 in step S104 starts, at the latest, before the completion of the operation of the magnetic actuator 31 in step S106.

Furthermore, in step S104, when the release motor 20 is actuated in the direction that releases the latch mechanism 11 and when the lock lever 22 pivots in the releasing direction, the door body 2 is slightly pushed open (popped up) by the force created by the elasticity of the weather strip to the half-latched position.

Note that the pop-up operation which pushes the door body 2 open to the half-latched position when the latch mechanism 11 is released is caused not only by the force created by the elasticity of the weather strip; the pop-up operation may be performed by force applied by an elastic member provided in a door hinge portion or may be performed by pivoting the door body 2 to the half-latched position with an electric motor.

After execution of step S104, when the door body 2 is pulled to the outside by the operator, the process proceeds from step S107 to step S108 and when the door body 2 is not pulled to the outside by the operator, the process proceeds from step S107 to step S109. When the process proceeds to step S109, at the time when the hand of the operator is released from the touch sensor 17, the lock lever 22 tries to return towards the initial position and the latch mechanism 11 gets into the half-latched state and stops its operation.

On the other hand, when the process proceeds to step S108, the latch mechanism 11 is switched to a released state from the half-latched state with the force created by the operator pulling the door body 2 to the outside. However, when the operator holding the outer handle 16 pulls the door body 2 open in a sequential manner without releasing his/her hand from the outer handle 16, the door body 2 is opened in a continuous manner without undergoing transition to the half-latched state (without becoming engaged in the half-latched position).

Figure 6:
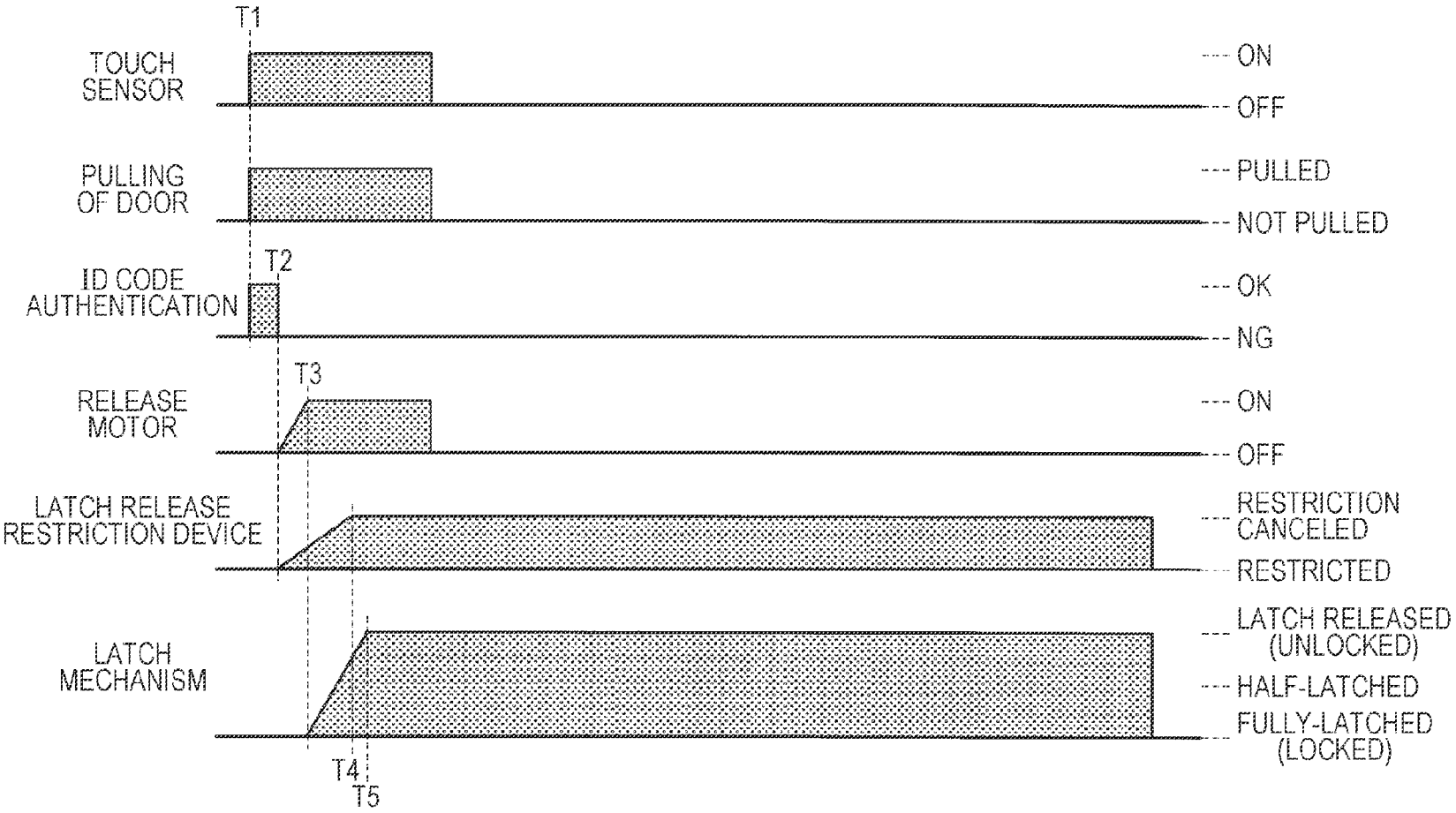
FIG. 6 is a timing chart illustrating a control timing of the door device according to the exemplary embodiment of the disclosure.

FIG. 6 is a timing chart illustrating a case in which the door body 2 is pulled to the outside in a sequential manner after the operator has held the outer handle 16.

In such a case, at T1, when the outer handle 16 is held by the operator, the touch sensor 17 is turned on and, then, authentication of the ID code is performed. After authentication is completed at T2, the latch releasing operation performed by the release motor 20 and the restriction cancelling operation of the latch release restriction device 15 performed by the electromagnetic actuator 31 are started at the same time. At this time, due to a structural reason, since it takes time for the restriction cancelling operation of the latch release restriction device 15 performed by the electromagnetic actuator 31 to be completed, the release of the engagement of the latch mechanism 11 performed by the release motor 20 is first completed at T3 and, then, the restriction cancelling operation of the latch release restriction device 15 performed by the electromagnetic actuator 31 is completed at T4. Then, after the above, at T5, the latch mechanism 11 is completely opened by further pushing the door body 2 open.

Figure 7:
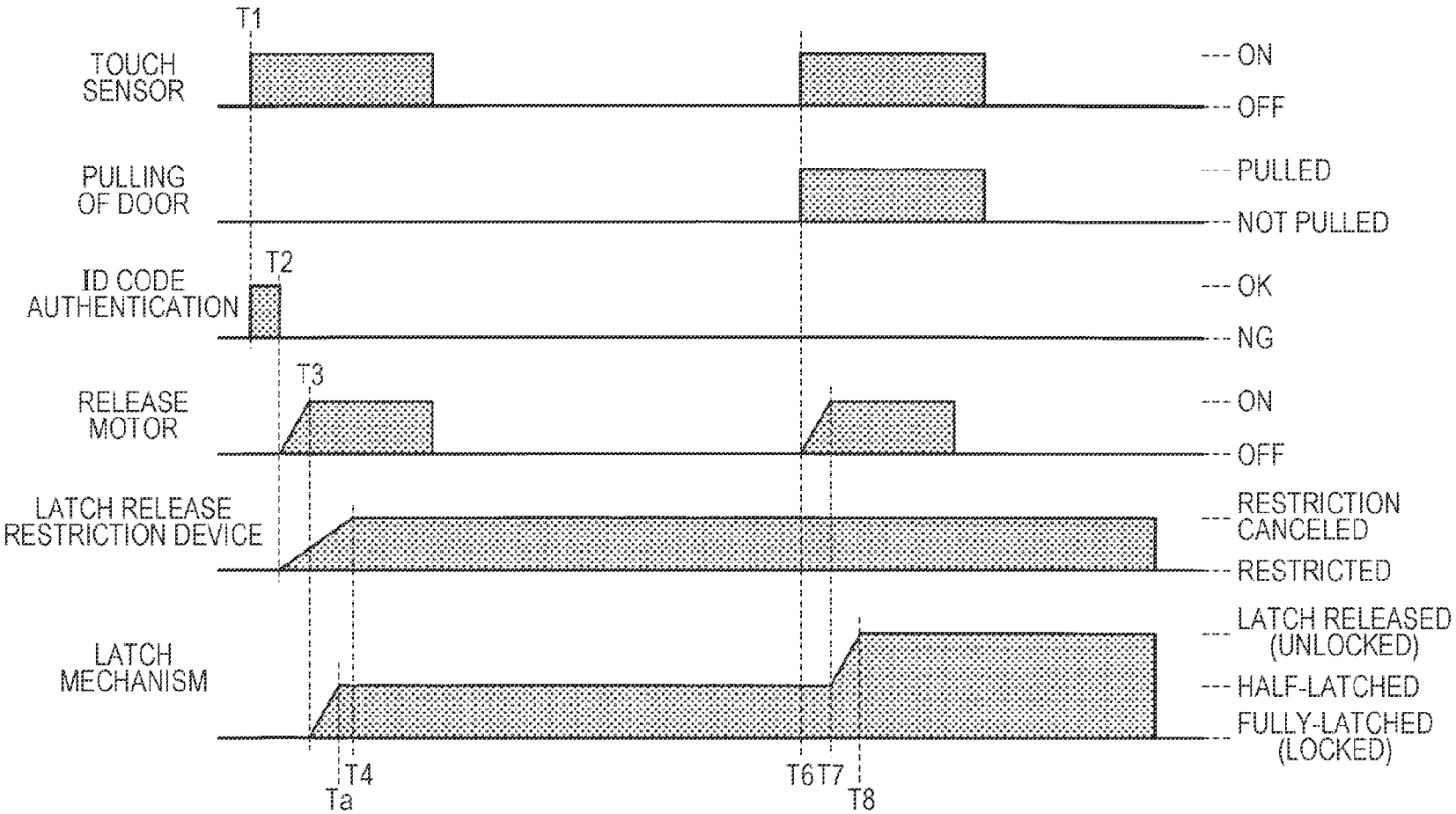
FIG. 7 is a timing chart illustrating a control timing of the door device according to the exemplary embodiment of the disclosure.

Furthermore, FIG. 7 is a timing chart illustrating a case in which the touch sensor 17 of the outer handle 16 is touched by the operator for a moment and, then, after a while, the outer handle 16 is pulled to the outside.

In such a case, at T1, the touch sensor 17 is turned on and, then, authentication of the ID code is performed. After authentication is completed at T2, the latch releasing operation performed by the release motor 20 and the restriction cancelling operation of the latch release restriction device 15 performed by the electromagnetic actuator 31 are started at the same time. In above case as well, the release of the engagement of the clutch mechanism 11 performed by the release motor 20 is completed at T3 before the completion of the restriction cancelling operation of the latch release restriction device 15 at T4 performed by the electromagnetic actuator 31; however, the latch mechanism 11 gets into the half-latched state at Ta immediately after T3 with a slight opening of the door body 2. In the above example, after the hand of the operator touches the touch sensor 17 of the outer handle 16, the hand of the operator is released from the touch sensor 17.

After the above, at T6, when the outer handle 16 is held by the operator and the outer handle 16 is pulled to the outside in a sequential manner, the actuation of the release motor 20 is started once more, and at T7, the releasing of the engagement of the latch mechanism 11 performed by the release motor 20 is completed. At T7, when the engagement of the latch mechanism 11 is released, the door body 2 is gradually pushed open with the outer handle 16, and at T8, the latch mechanism 11 is completely released.

As described above, in the door device 10 according to the present exemplary embodiment, when an operator possessing a legitimate electronic key touches the touch sensor 17 of the outer handle 16 serving as an opening switch, an operation signal is output to the electromagnetic actuator 31 of the latch release restriction device 15 and to the release motor 20 of the latch mechanism 11, and the release motor 20 serving as a latch release actuator is actuated in the latch releasing direction without waiting for the cancellation of the restriction of the latch release restriction device 15 to be completed. Accordingly, when the door body 2 is in a locked state, the engagement of the latch mechanism 11 can be swiftly released from the outside of the vehicle to open the door body 2.

In other words, even if link between the inner handle 12 and the latch mechanism 11 is not completely disabled (even if the locked state is not completely canceled) with the latch release restriction device 15 after the operator has touched the touch sensor 17 of the outer handle 16, the door body 2 can be immediately opened to the outside in a sequential manner from immediately after the release motor 20 has released the engagement of the latch mechanism 11 by merely pulling the outer handle 16 to the outside.

Furthermore, in the door device 10 according to the present exemplary embodiment, when the link between the inner handle 12 and the latch mechanism 11 is enabled, the latch mechanism 11 can be released through the wire 13 by operating the inner handle 12 from the vehicle interior. Accordingly, even if the electric release motor 20 should malfunction when the occupant is inside the vehicle, the latch mechanism 11 can be released by operating the inner handle 12 from the vehicle interior.

Note that the operation transmission member that mechanically transmits the operation of the inner handle 12 to the latch mechanism 11 is not limited to the wire 13 and may be another member, such as a link member or a gear.

In the door device 10 of the exemplary embodiment, the releasing operation of the latch mechanism 11 is carried out with the wire 13 by performing a pulling operation with the inner handle 12, the latch release restriction device 15 includes the engagement piece 30 that is connected to the wire 13 and that can be engaged with the inner handle 12, and the link between the inner handle 12 and the latch mechanism 11 can be disabled and restricted by releasing the engagement piece 30 from the inner handle 12; accordingly, the inner handle 12 can be prevented from unintentionally moving in an abrupt manner when the latch mechanism 11 is actuated in the engagement releasing direction with the release motor 20.

In other words, in the door device 10 of the present exemplary embodiment, even if the latch mechanism 11 is operated in the engagement releasing direction with the release motor 20 when the inner handle 12 is not operated, the slack of the wire 13 can nullify or relieve the transmission of the operation from being abruptly transmitted from the latch mechanism 11 to the inner handle 12.

Furthermore, in the door device 10 of the present exemplary embodiment, since the inner handle 12 that is disposed in the vehicle interior is connected to the latch mechanism 11 with the wire 13 so as to be capable of being linked with the latch mechanism 11 and since a touch sensor 17 serving as an opening switch is provided in the outer handle 16 disposed on the vehicle exterior side, even if the release motor should malfunction when an occupant is in the vehicle interior, the occupant can escape to the outside of the vehicle by operating the inner handle 12 from the vehicle interior, and the engagement of the latch mechanism 11 can be easily released by performing a touch operation on the touch sensor 17 when outside the vehicle where there is no worry of the occupant being locked in.

Note that in the door device 10 of the present exemplary embodiment, while only the inner handle 12 on the vehicle interior side is mechanically connected to the latch mechanism 11 through the latch release restriction device 15 and the operation transmission member (the wire 13), the outer handle 16 on the vehicle exterior side may also be mechanically connected in a similar manner to the latch mechanism 11 through the release control device and the operation transmission member. Furthermore, the opening switch is not limited to the touch sensor 17 and may be a switch of another type, such as a button operation type or a slide operation type.

Furthermore, in the door device 10 of the exemplary embodiment, when the opening operation of the door body 2 is to be locked when the occupant is not in the vehicle, the actuation of the latch mechanism 11 being operated in the engagement releasing direction with the release motor 20 is restricted while the link between the inner handle 12 and the latch mechanism 11 performed by the latch release restriction device 15 is kept active (keeping the restriction of the link cancelled); accordingly, generation of abnormal noise generated by operation of the engagement piece 30 of the latch release restriction device 15 can be prevented. Accordingly, since the door device 10 does not generate any unpleasant noise when the door is locked when getting out of the vehicle, marketability is increased.

Furthermore, in the door device 10, when the touch sensor 17 is operated without any opening operation being carried out on the door body 2 when the latch mechanism 11 is in a fully-latched state, the half-latched state is maintained until an opening operation is performed on the door body 2; accordingly, even if the operator touches the touch sensor 17 by mistake, the door body 2 can be prevented from opening abruptly before anything happens.

Furthermore, in the door device 10 of the present exemplary embodiment, since the touch sensor 17 is attached to the holding portion **16*a* of the outer handle 16 held by the operator to open and close the door body 2, by pulling the door body 2 while holding the holding portion 16*a* of the outer handle 16, the operator can perform an opening operation of the door body 2 in a continuous manner after the release of the engagement of the latch mechanism 11**.

Note that in the present exemplary embodiment, the touch sensor 17 is attached only to the holding portion **16*a* of the outer handle 16; however, a touch sensor (an opening switch) may be attached to the holding portion of the inner handle 12** in a similar manner.

Furthermore, in the door device 10 according to the present exemplary embodiment, since the latch mechanism 11 is kept at an engagement released state while the operator holds the holding portion **16*a* of the outer handle 16 and touches the touch sensor 17, the latch mechanism 11 does not undergo transition to the half-latched state when the operator holding the outer handle 16 tries to push open the door body 2 in a sequential manner. Accordingly, in the door device 10, the door body 2** can be pushed open smoothly without being caught in the half-latched position.

Note that the disclosure is not limited to the exemplary embodiment described above and various design changes may be made without departing from the scope of the disclosure. For example, in the exemplary embodiment described above, the latch release restriction device 15 is provided at a portion where the inner handle 12, which is connected to one end of the wire 13, is disposed; however, the latch release restriction device 15 may be provided, for example, in an operation input portion of the latch mechanism 11, which is connected to the other end of the wire 13. Furthermore, in the exemplary embodiment described above, the mechanism of the door device is applied to a hinge opening and closing type side door; however, a similar mechanism of the door device may be applied to, for example, a slide opening and closing type side door or a hinge opening and closing type tail gate. In such a case, it is preferable that the mechanism of the door device be applied to a door that is not electrically driven. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

What is claimed is:

1. A vehicular door device comprising:

a door body attached to a door opening portion of a vehicle in an openable and closable manner;

a latch mechanism provided in the door body, the latch mechanism including a latch that, when the door body is in a closed state, engages with a striker of a vehicle body and restricts the door body from being displaced in an opening direction;

a release handle mechanism that is provided in the door body, the release handle mechanism releasing the engagement between the latch and the striker according to an operation of an operator;

an operation transmission member that mechanically transmits an operation of the release handle mechanism to the latch;

a latch release restriction device provided midway of an operation transmission path starting from the release handle mechanism to the latch via the operation transmission member, the latch release restriction device disabling and restricting a link between the release handle mechanism and the latch through the operation transmission path;

a latch release actuator linked to the latch without having the operation transmission member and the latch release restriction device between the latch release actuator and the latch, the latch release actuator actuating the latch in an engagement releasing direction without by means of the operation transmission member and the latch release restriction device; and a door opening switch that, when a switch operation is performed by the operator, cancels a restriction by the latch release restriction device to the link between the release handle mechanism and the latch, wherein the operation transmission member is mechanically connected to the latch to mechanically transmit a mechanical power generated by the release handle mechanism to the latch to mechanically drive the latch in the engagement releasing direction independently from the latch release actuator, wherein when the switch operation is performed on the door opening switch, a cancellation of the restriction by the latch release restriction device to the link is performed and the latch release actuator is actuated in the engagement releasing direction without waiting for the cancellation of the restriction to be completed.

2. The vehicular door device according to claim 1, wherein the operation transmission member is a wire that performs a releasing operation of the latch caused by a pulling operation of the release handle mechanism, the latch release restriction device includes an engagement piece that is connected to the wire and is capable of being engaged to and released from the release handle mechanism, and releasing of the engagement piece from the release handle mechanism disables and restricts the link between the release handle mechanism and the latch.

3. The vehicular door device according to claim 1, wherein the release handle mechanism is provided on at least a vehicle interior side of the door body and the door opening switch is provided on at least a vehicle exterior side of the door body.

4. The vehicular door device according to claim 3, wherein when locking the door body so as not to open without an occupant being in the vehicle, the operation of the latch in the engagement releasing direction performed by the latch release actuator is restricted while the restriction of the link between the release handle mechanism and the latch by the latch release restriction device remains cancelled.

5. The vehicular door device according to claim 1, wherein the latch gets into a fully-latched state, the fully-latched state being a state in which the latch is engaged with the striker of the vehicle body while the door body is in a completely closed state, and into a half-latched state, the half-latched state being a state in which the latch is engaged with the striker of the vehicle body while the door body is not in a completely closed state, and while the latch is in the fully-latched state, when the opening switch is operated with no performance of an opening operation exerted on the door body, the latch is kept in the half-latched state until the opening operation is performed on the door body.

6. The vehicular door device according to claim 5, wherein the door opening switch is provided in a holding portion of the door body, the holding portion being held by the operator to open and close the door body.

7. The vehicular door device according to claim 6, wherein the door opening switch maintains the latch in an engagement released state while the holding portion is held by the operator.

8. The vehicular door device according to claim 1 further comprising a controller, wherein the controller detects the switch operation performed on the door opening switch, instructs cancellation of the restriction by the latch release restriction device to the link, and actuates the latch release actuator in the engagement releasing direction prior to completion of the cancellation of the restriction.

9. The vehicular door device according to claim 8, wherein the controller initiates the cancellation of the restriction and the actuation of the latch release actuator simultaneously.

10. The vehicular door device according to claim 1, wherein the latch release actuator completes the releasing of the latch prior to completion of the cancellation of the restriction to restore the link.

11. The vehicular door device according to claim 8, wherein the controller performs authentication process before actuating the latch release actuator.

12. A vehicle comprises the vehicular door device according to claim 1.

13. The vehicular door device according to claim 8, wherein the controller maintains the latch in an engagement released state during a time when the controller detects the switch operation performed on the door opening switch.

14. A vehicular door device comprising:

a door body attached to a door opening portion of a vehicle in an openable and closable manner;

a latch mechanism provided in the door body, the latch mechanism including a latch that, when the door body is in a closed state, engages with a striker of a vehicle body and restricts the door body from being displaced in an opening direction;

a release handle mechanism that is provided in the door body, the release handle mechanism releasing the engagement between the latch and the striker according to an operation of an operator;

an operation transmission member that mechanically transmits an operation of the release handle mechanism to the latch;

a latch release restriction device provided midway of an operation transmission path starting from the release handle mechanism to the latch via the operation transmission member, the latch release restriction device disabling and restricting a link between the release handle mechanism and the latch through the operation transmission path;

a latch release actuator linked to the latch without having the operation transmission member and the latch release restriction device between the latch release actuator and the latch, the latch release actuator actuating the latch in an engagement releasing direction without by means of the operation transmission member and the latch release restriction device;

a door opening switch sensing a switch operation performed by the operator; and a controller, wherein the operation transmission member is mechanically connected to the latch to mechanically transmit a mechanical power generated by the release handle mechanism to the latch to mechanically drive the latch in the engagement releasing direction independently from the latch release actuator, wherein the controller detects the switch operation performed on the door opening switch by receiving a sensing signal from the door opening switch, cancels the restriction by the latch release restriction device to the link, and actuates the latch release actuator in the engagement releasing direction prior to completion of the cancellation of the restriction.

15. The vehicular door device according to claim 1, wherein the operation transmission member is coupled to the latch, and the latch release actuator is coupled to the latch in parallel to the operation transmission member.

16. The vehicular door device according to claim 14, wherein the operation transmission member is coupled to the latch, and the latch release actuator is coupled to the latch in parallel to the operation transmission member.

* * * * *